US005957745A

United States Patent [19]

Johnson et al.

[11] Patent Number: 5,957,745

[45] Date of Patent: Sep. 28, 1999

[54] GYROSCOPIC FIGURINE

[75] Inventors: Lonnie G. Johnson, Smyrna; John T. Applewhite, Atlanta, both of Ga.

[73] Assignee: Johnson Research & Development Company, Inc., Smyrna, Ga.

[21] Appl. No.: 09/012,980

[22] Filed: Jan. 26, 1998

[51] Int. Cl.[6] ..... A63H 1/00

[52] U.S. Cl. ..... 446/234; 446/233; 446/256

[58] Field of Search ..... 446/3, 233–236, 446/256, 259, 264

[56] References Cited

U.S. PATENT DOCUMENTS

| | | | |
|---|---|---|---|
| 99,644 | 3/1870 | Coombs . | |
| 1,098,895 | 6/1914 | Edgar . | |
| 1,584,979 | 5/1926 | Clausen . | |
| 2,148,374 | 2/1939 | Hogan | 46/50 |
| 2,195,083 | 3/1940 | Einfalt | 46/50 |
| 4,277,912 | 7/1981 | Hsien . | |
| 4,952,189 | 8/1990 | Barlow | 446/241 |
| 5,601,471 | 2/1997 | Kennedy | 446/236 |
| 5,823,845 | 10/1998 | O'Berrigan | 446/234 |

*Primary Examiner*—Robert A. Hafer
*Assistant Examiner*—Laura Fossum
*Attorney, Agent, or Firm*—Kennedy, Davis & Hodge

[57] ABSTRACT

A gyroscopic figurine (10) is disclosed having a body (11) and a gyroscope (12) mounted within the body. The gyroscope (12) has a rotatable wheel (15) coupled with the shaft (23) of an electric motor (16). The shaft is oriented at an angle to the axis of rotation (21) of the gyroscope wheel to cause a slight unbalancing or wobbling effect as the wheel rotates. The body has a torso (26), a head (28), pivoting arms (29), a fixed leg (30), and a moveable leg (33). The relative positioning of the arms, legs and torso cause the figurine to become unbalanced and thus move while the gyroscope operates. The unbalancing of the gyroscopic wheel causes the figurine to vibrate and thus enhance the skating effect of the figurine upon an underlying surface.

26 Claims, 2 Drawing Sheets

GYROSCOPIC FIGURINE

TECHNICAL FIELD

This invention relates generally to gyroscopic figurines and more specifically to gyroscopic figurines which move upon a supporting surface.

BACKGROUND OF THE INVENTION

Figurines, such as dolls, have existed for centuries. Today's dolls typically have manually manipulable legs, arms and heads. These dolls may be articulated to assume many different positions. However, these dolls are generally considered static as they do not move under their own power.

To overcome this static problem, dolls which can dance or skate have been designed which include a gyroscope mounted within the body of the doll, as shown in U.S. Pat. Nos. 99,644, 1,098,895, 1,584,979, 2,148,374 and 2,195,083. The gyroscope allows the dolls to balance and rotate upon one leg. The U.S. Pat. Nos. 99,644, 1,098,895 and 2,195,083 show dolls having a pivot leg aligned with the axis of rotation of the gyroscope wheel. These dolls on the most part however simply rotate in one place. The U.S. Pat. No. 1,584,979 shows a doll having a leg which pivots outwardly due to the centrifugal force upon the leg as the doll rotates. The U.S. Pat. Nos. 1,098,895 and 2,148,374 show mobile improvements on the basic concepts. The doll of the U.S. Pat. No. 1,098,895 has an arm which pivots, thereby changing the centrifugal force and thus the speed of doll rotation. The doll of the U.S. Pat. No. 2,148,374 has its pivot leg point of contact with the underlying surface offset from the gyroscopes axis of rotation. The offset causes the doll to move along the underlying supporting surface. These dolls however typically have a limited range of motions, and thus quickly become uninteresting to a child.

It thus is seen that a need remains for a figurine which can move under its own power in different manners. It is to the provision of such that the present invention is primarily directed.

SUMMARY OF THE INVENTION

In a preferred form of the invention, a figurine comprises a body portion and a gyroscope mounted within the body portion. The gyroscope has a rotatable wheel having an axis of rotation and an axle mounted to the rotatable wheel in a position offset from the rotatable wheel axis of rotation. With this construction, the offset positioning of the axle causes the gyroscope to vibrate during rotation which in turn causes the figurine to slide relative to a surface supporting the figurine.

DETAILED DESCRIPTION

Figure 1:
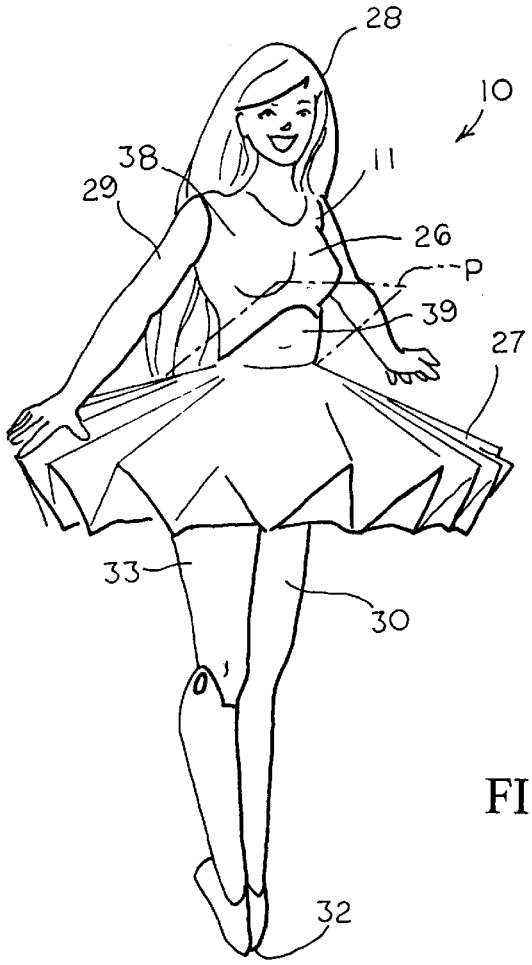
FIG. 1 is a perspective view of a gyroscopic figurine of the present invention shown in a preferred form.

With reference next to the drawing, there is shown a gyroscopic figurine 10 in the form of a ballet dancing doll.

The figurine 10 has a body 11 and a gyroscope 12 mounted within the body 11.

Figure 3:
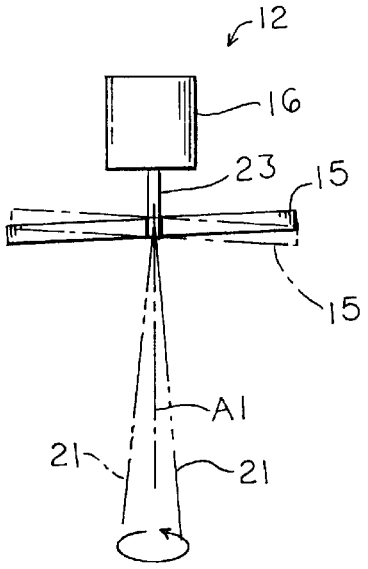
FIG. 3 is a side view of the rotatable wheel and motor shaft of the gyroscopic figurine of FIG. 1.

The gyroscope 12 has a fly-wheel rotor or rotatable wheel 15 coupled to an electric motor 16 with an electric power source 17 such as a battery. The rotatable wheel 15 has a hub 18, a weighted peripheral ring 19, and an axis of rotation 21 shown in phantom lines in FIG. 3. An unshown on/off switch is electronically coupled between the power source 17 and electric motor 16. The motor 16 has an axle or drive shaft 23 coupled to the rotatable wheel hub 18. As shown in FIG. 3, the shaft 23 has a longitudinal axis A1 oriented at an oblique angle to the rotatable wheel axis of rotation 21 so as to cause a slight unbalancing or wobbling effect as the wheel 15 rotates.

Figure 2:
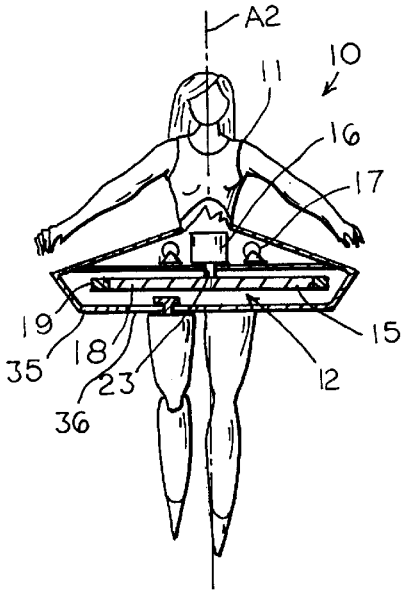
FIG. 2 is a partial cross-sectional view of the gyroscopic figurine of FIG. 1.

The body 11 has a torso 26 with an enlarged skirt 27 encasing the gyroscope wheel 15, a head 28, pivoting arms 29, a fixed leg 30 having an underlying surface point of contact 32 generally aligned with shaft 23, and a moveable leg 33. As best shown in FIG. 2, the skirt 27 has a bottom wall 35 with a slot 36 therethrough in which is mounted the moveable leg 33 for repositionable movement along the slot and relative to the longitudinal axis of the figurine A2. The torso 26 is bisected along a plane P oriented at an oblique angle to the longitudinal axis of the figurine A2 so as to form an upper portion 38 and a lower portion 39.

Figure 4:
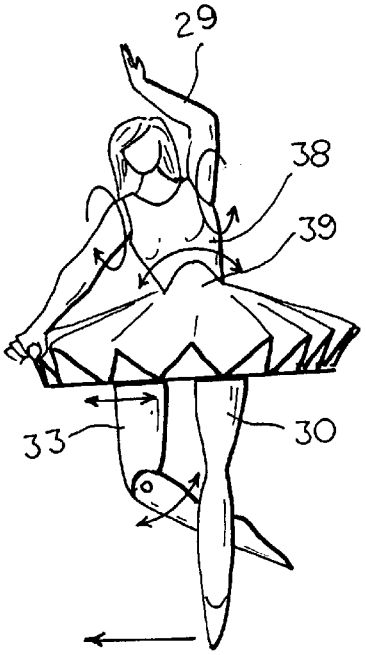
FIG. 4 is front view of the gyroscopic figurine of FIG. 1, shown with the torso rotated to an unbalanced position.

In use, an operator orients the torso upper portion 38, the arms 29, and moveable leg 33 to a desired position. The on/off switch is actuated to its on position enabling the electric motor 16 and thus causing the rotation of the wheel 15. The offset angle of the wheel axis of rotation 21 compared with the longitudinal axis A1 of the shaft 23 causes the rotating wheel to tilt or wobble as it rotates, as best shown in FIG. 3. This wobbling of the gyroscope causes the entire figurine to vibrate, as oppose to the customary generally stable gyroscopic operation of the prior art figurines. This vibration causes the figurine fixed leg point of contact 32 to skate or slide across the underlying surface. The direction of the figurine and the rotation thereof is dependent upon the positioning of the arms, leg and torso. The more off-balanced the positioning of the arms, leg and torso from the doll longitudinal axis the more dramatic the tilting of the gyroscope and the resulting movement. The figuring tends to move in a direction of the tilting of the gyroscope, as indicated by the bottom arrow in FIG. 4.

The positioning of the torso upper portion 38 tends to cause the most severe tilting of the gyroscope while the pivoting of the arms tends to cause the least tilting. However, it should be understood that such is dependent upon the relative weight and the resulting torquing force of each portion. The tilting of the figurine and the figure speed of rotation, if any, is also controlled through the relative positioning of the moveable leg. The more outboard the leg is positioned the more the figurine tilts during operation and the slower the speed of figurine rotation. Additionally, the positioning of the moveable leg may cause the toe of the moveable leg to come into contact with the underlying surface as the figurine moves across the surface. This contacting of the moveable leg will cause a movement force which unbalances the figurine and causes it to spin or abruptly change its direction. Also, the appendages and torso may be moved into positions which counteract each other or which in combination causes a change in the rotation or rotation speed of the figurine.

Figure 5:
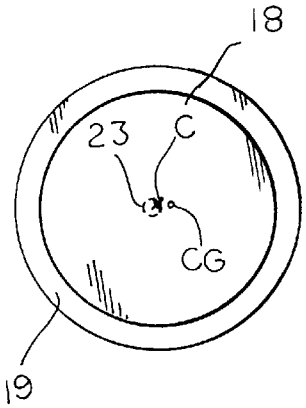
FIG. 5 is a top view of the gyroscopic wheel in an alternative embodiment.

It should be understood that the present invention is not limited to motorized gyroscopes, but also those which utilize a manual pull string and those which are mechanically rotated by an independent mechanical source. It should also be understood that the critical unbalancing of the gyroscope wheel may also be accomplished by a weight difference along the wheel, i.e. the wheel center of gravity CG being offset from the location of the shaft 23, or the positioning of the motor shaft 23 being offset from the physical center point C of the wheel, as shown in FIG. 5.

From the foregoing, it is seen that a figurine having a gyroscope therein is now provided which overcome problems long associated with those of the prior art. It should however be understood that the just described embodiment merely illustrates principles of the invention in its preferred forms. Many modifications, additions and deletions, in addition to those expressly recited, may of course, be made thereto without departure from the spirit and scope of the invention as set forth in the following claims.

We claim:

1. A figurine comprising a body portion and a gyroscope mounted within said body portion, said gyroscope having a rotatable wheel having an axis of rotation and an axle mounted to said rotatable wheel having a longitudinal axis of rotation, said wheel axis of rotation being oriented at an angle to said axle axis of rotation, whereby the angled orientation of the axle axis with respect to the wheel axis causes the gyroscope to vibrate during rotation which in turn causes the figurine to slide relative to a surface supporting the figurine.

2. The figurine of claim 1 wherein said axle is offset from the geometric center of said wheel.

3. The figurine of claim 2 wherein said body portion has at least one pivotal arm extending from said torso.

4. The figurine of claim 1 wherein said axle is offset from the center of gravity of said wheel.

5. The figurine of claim 1 wherein said body portion has a torso, a fixed leg extending from said torso positioned substantially along said axle, and a repositionable leg movably coupled to said torso, said repositionable leg being mounted for relative movement along said torso for varying the distance between said axle and said repositionable leg.

6. The figurine of claim 1 wherein said body portion has a torso with a first portion and a second portion coupled to said first portion for relative movement of said second portion relative to said axle.

7. The figurine of claim 6 wherein said second portion is coupled to said first portion along a dividing plane oriented at an oblique angle to said axle.

8. The figurine of claim 1 wherein said body portion has at least one pivotal arm.

9. The figurine of claim 1 further comprising an electric motor coupled to said gyroscope rotatable wheel.

10. A figurine comprising a body portion and a gyroscope mounted to said body portion, said gyroscope having a rotatable wheel having an axis of rotation and an axle mounted to said rotatable wheel having a longitudinal axis of rotation, said wheel axis of rotation being oriented at an angle to said axis of rotation, said body portion having a torso, a fixed leg extending from said torso positioned substantially along said axle, and a repositionable leg movably coupled to said torso, said repositionable leg being mounted for relative movement along said torso for varying the distance between said axle and said repositionable leg.

11. The figurine of claim 10 wherein said torso has a first portion and a second portion coupled to said first portion for relative movement of said second portion relative to said axle.

12. The figurine of claim 11 wherein said second portion is coupled to said first portion along a dividing plane oriented at an oblique angle to said axle.

13. The figurine of claim 10 wherein said body portion has at least one pivotal arm.

14. The figurine of claim 13 wherein said torso with a first portion and a second portion coupled to said first portion for relative movement of said second portion relative to said axle.

15. The figurine of claim 14 wherein said second portion is coupled to said first portion along a dividing plane oriented at an oblique angle to said axle.

16. The figurine of claim 10 further comprising an electric motor coupled to said gyroscope rotatable wheel.

17. The figurine of claim 10 wherein said axle is positioned with its longitudinal axis oriented at an oblique angle to said axis of rotation.

18. The figurine of claim 10 wherein said axle is offset from the geometric center of said wheel.

19. The figurine of claim 10 wherein said axle is offset from the center of gravity of said wheel.

20. A figurine comprising a body portion and a gyroscope mounted to said body portion, said gyroscope having a rotatable wheel having an axis of rotation and an axle coupled to said rotatable wheel having a longitudinal axis of rotation, said wheel axis of rotation being oriented at an angle to said axle axis of rotation, said body portion having a torso with a first portion and a second portion coupled to said first portion and having a longitudinal axis, said second portion being moveable for different positions of said torso axis relative to said to said axle axis.

21. The figurine of claim 20 wherein said second portion is coupled to said first portion along a dividing plane oriented at an oblique angle to said axle.

22. The figurine of claim 20 wherein said body portion has a fixed leg extending from said torso and having an underlying surface contact point positioned substantially along said axle, and a repositionable leg movably coupled to said torso, said repositionable leg being mounted for relative movement along said torso for varying the distance between said axle and said repositionable leg.

23. The figurine of claim 20 wherein said body portion further comprises at least one pivotal arm.

24. The figurine of claim 20 further comprising an electric motor coupled to said gyroscope rotatable wheel.

25. The figurine of claim 20 wherein said axle is offset from the geometric center of said wheel.

26. The figurine of claim 20 wherein said axle is offset from the center of gravity of said wheel.

* * * * *